US010580391B2

(12) United States Patent
Tobias

(10) Patent No.: US 10,580,391 B2
(45) Date of Patent: Mar. 3, 2020

(54) VIBRATO DEVICE FOR GUITAR

(71) Applicant: Martine Tobias, Bayonne, NJ (US)

(72) Inventor: Martine Tobias, Bayonne, NJ (US)

( * ) Notice: Subject to any disclaimer, the term of this patent is extended or adjusted under 35 U.S.C. 154(b) by 0 days.

(21) Appl. No.: 16/240,933

(22) Filed: Jan. 7, 2019

(65) Prior Publication Data

US 2019/0244590 A1 Aug. 8, 2019

Related U.S. Application Data

(60) Provisional application No. 62/627,396, filed on Feb. 7, 2018.

(51) Int. Cl.

| | |
|---|---|
| ***G10D 3/00*** | (2006.01) |
| ***G10D 3/14*** | (2020.01) |
| ***G10D 1/08*** | (2006.01) |
| ***G10D 3/12*** | (2020.01) |

(52) U.S. Cl.
CPC ..... *G10D 3/146* (2013.01); *G10D 1/08* (2013.01); *G10D 3/12* (2013.01)

(58) Field of Classification Search
CPC ..... G10D 3/146; G10D 1/08; G10D 3/12
USPC ..... 84/313
See application file for complete search history.

(56) References Cited

U.S. PATENT DOCUMENTS

| | | | | |
|---|---|---|---|---|
| D169,120 | S | 3/1953 | Bigsby | |
| D170,109 | S | 8/1953 | Bigsby | |
| 4,100,832 | A * | 7/1978 | Peterson | G10D 3/146 84/313 |
| 4,171,661 | A | 10/1979 | Rose | |
| 4,497,236 | A | 2/1985 | Rose | |
| 4,864,909 | A * | 9/1989 | Toney | G10D 3/146 84/313 |
| 4,903,568 | A | 2/1990 | Itoh | |
| 8,796,524 | B1 | 8/2014 | Deck | |
| 9,330,639 | B1 | 5/2016 | Armstrong | |
| 2013/0291705 | A1 | 11/2013 | Rose | |
| 2016/0232881 | A1 | 8/2016 | Alday | |

FOREIGN PATENT DOCUMENTS

WO WO 2016/149747 9/2016

* cited by examiner

*Primary Examiner* — Jianchun Qin
(74) *Attorney, Agent, or Firm* — Hill Wallack LLP; Jason L. DeFrancesco

(57) ABSTRACT

An improved Bigsby vibrato device for a guitar. The improved device includes a mechanical stop which ensures that the device returns to its original neutral position after being used, thereby preventing mistuning of the guitar. The mechanical stop may be a hard stop which prevents the device from increasing tension on the guitar strings (thereby raising the pitch) beyond the neutral position, or it may be a spring stop which allows the user to increase the tension on the strings beyond the neutral position by pulling upward on the device arm with a force sufficient to overcome the spring stop.

12 Claims, 9 Drawing Sheets

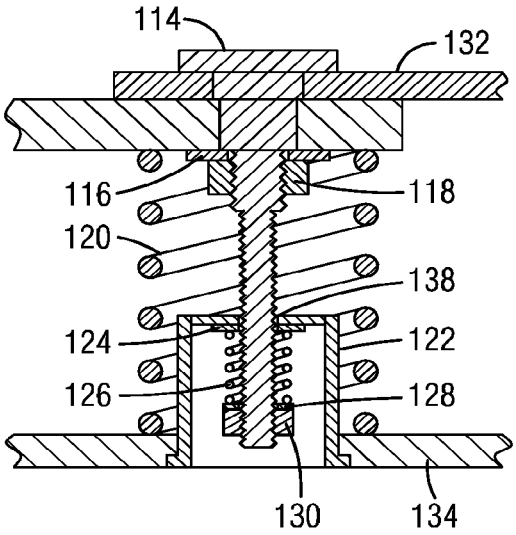
FIG. 8C
FIG. 8D
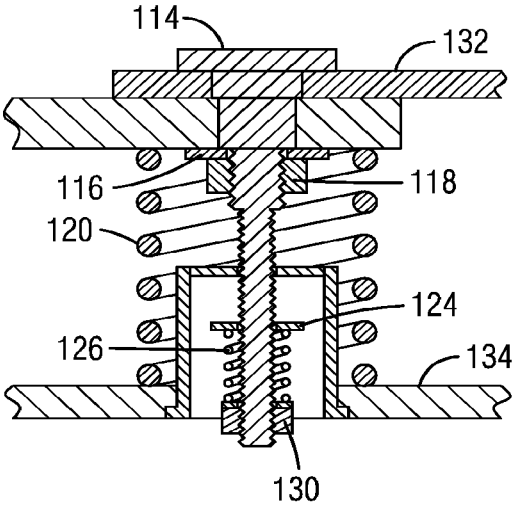
FIG. 8E
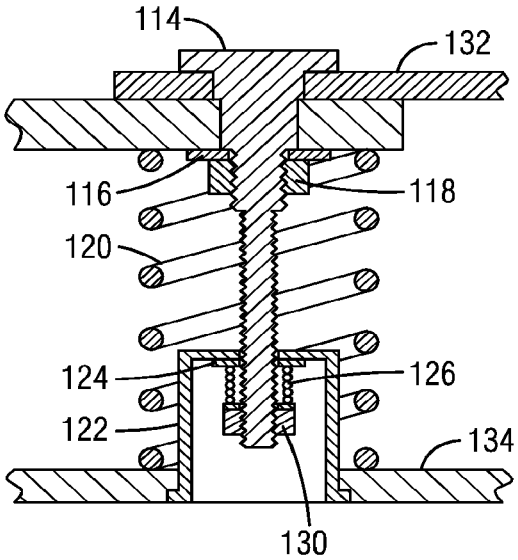

VIBRATO DEVICE FOR GUITAR

This application claims benefit of the 7 Feb. 2018 filing date of U.S. provisional patent application No. 62/627,396, which is incorporated by reference herein.

FIELD OF THE INVENTION

This invention relates generally to the field of musical instruments, and more particularly to electric guitars, and specifically to an improvement for a vibrato device for a guitar to better keep the guitar in tune.

BACKGROUND OF THE INVENTION

More than sixty years ago, Paul A. Bigsby invented a device which allows a musician to modify the pitch of an electric guitar while it was being played (see, for example, U.S. Pat. Nos. Des. 169,120 and 170,109). Variations of such devices are now commonly referred to as whammy bars, vibrato bars or (incorrectly) tremolo arms. By pushing down or pulling up on the arm of the device, a musician can lower or raise the tension in the guitar strings and the resulting pitch of the note/chord being played on the guitar.

The design of a Bigsby vibrato device has changed little over the years. A typical Bigsby vibrato device is illustrated in FIG. 1. The Bigsby device 10 is configured for installation on the top of the body of a guitar (not illustrated), and it includes a rotatable rod or bar 12 to which the guitar strings (not illustrated) are terminated at the bridge end of the guitar. A spring-loaded arm 14 is attached to the rod 12 so that movement of the arm 14 causes rotation of the rod 12 about its longitudinal axis A-A. Attachment of the arm 14 to the device 10 may allow rotation of the arm 14 about a vertical axis (directional notations herein assume that the vibrato device, or guitar to which it is attached, is laying on a horizontal surface with the guitar strings upward). Tension in the strings imposes a rotational force on the rod 12 which is balanced by the force of the spring 16 located under the arm 14. Movement of the arm 14 downward by a user of the device causes rotation of the rod 12 in a direction which decreases the tension in the strings to lower the pitch, and movement of the arm 14 upward by the user increases the tension in the strings to raise the pitch.

One disadvantage of a Bigsby vibrato device is that the arm/rod does not always return to exactly the same neutral/rest position when released due to mechanical tolerances and friction in the Bigsby device or guitar. Movement at either terminus of a guitar string will affect the tension in the string, and an error of as little as a thousandth of an inch in the neutral return position of the Bigsby device can change the pitch of a string by as much as one-half full tone. Thus, the use of a Bigsby device necessitates frequent tuning of a guitar, and can even cause mistuning of the guitar during the playing of a single song.

Competing vibrato device designs have been introduced over the years in an attempt to address the Bigsby mistuning issue and to provide a larger range of tone change than is provided by a Bigsby device. Floyd D. Rose was awarded U.S. Pat. No. 4,171,661 in 1979 for a competing device called a Floyd Rose Tremolo, and he was awarded U.S. Pat. No. 4,497,236 in 1985 for a fine tuning device which can be used in conjunction with the Floyd Rose device. However, many musicians still prefer the tonal quality and feel of the original Bigsby vibrato device. Yet, tone stability when using a Bigsby device remains problematic, as may be evidenced by searching "Bigsby tuning" on the popular internet site youtube.com. Thus, a solution to the mistuning caused by a Bigsby vibrato device remains a long felt need.

BRIEF DESCRIPTION OF THE DRAWINGS

The invention is explained in the following description in view of the drawings that show:

FIG. 8C is a cut away view of the broken lined portion of 112 from FIG. 8B where the device is neutral.

FIG. 8D is a cut away view of the broken lined portion of 112 from FIG. 8B where the device is in a state wherein rotatable arm extension 132 is pushed downward.

FIG. 8E is a cut away view of the broken lined portion of 112 from FIG. 8B where the device is in a state wherein rotatable arm extension 132 is pulled upward.

Like structures shown in multiple figures are generally numbered consistently when illustrated in multiple figures.

DETAILED DESCRIPTION OF THE INVENTION

The present invention improves upon known vibrato devices by adding a mechanical stop which defines a neutral position of the device to which the device will reliably return following its use. When a musician or other user of a guitar equipped with a prior art vibrato device releases the arm after changing the pitch, the device may not always return exactly to its original position. By adding a stop to define the neutral position, the improved device can be set up to ensure that the arm/bar will always return to the same original neutral position, thereby maintaining the same tension and pitch in the strings every time that the arm is released.

Figure 2:
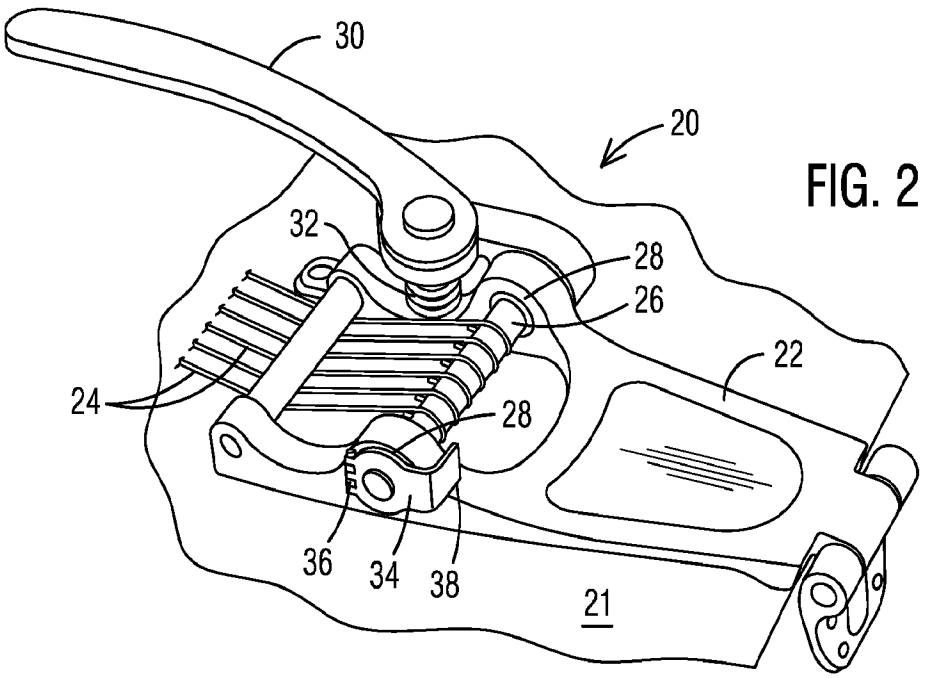
FIG. 2 is a perspective view of an embodiment of the invention.

FIG. 2 illustrates one embodiment of an improved Bigsby vibrato device 20 in accordance with an embodiment of the invention. The device 20 includes a frame 22 configured for attachment to a top surface of a guitar 21 in any known manner. Strings 24 of the guitar are attached to a rod 26 which is rotatably supported at its opposed ends by respective bearing areas 28. An arm 30 is attached at one end of the rod 26 so that movement of the arm 30 toward or away from the top surface of the guitar 21 will cause rotation of the rod 26 about its longitudinal axis, thereby loosening or tightening the tension of the strings 24 respectively. A spring 32 disposed under the arm 30 and between the frame 22 and the arm 30 biases the arm 30 upward. The structures thus far described in FIG. 2 are common for prior art Bigsby devices. The present invention adds a stop mechanism, such as hard stop 34. Hard stop 34 is attached to the rod 26 proximate an end of the rod 26 so that it rotates with the rod 26 about the longitudinal axis when the arm 30 is moved. The stop 34 may be attached to the rod 26 by a clamp mechanism 36, as illustrated, or in any other manner, such as by bolting, welding or by being integrally formed. The hard stop 34 in this embodiment is formed as an L-shaped plate. The hard stop 34 is free to rotate in one direction (counterclockwise in FIG. 2) when the arm 30 is moved downward toward the guitar surface 21. However, when the arm 30 is released by the user and is urged away from the guitar surface 21 by spring 32, the bottom surface 38 of the stop 34 eventually makes contact with the frame 22, thereby defining a repeatable neutral position of the device 20. In this manner, the tuning of the guitar is returned to the same setting each time the device 20 is used and released. To achieve this functionality, the guitar is tuned in a manner which ensures that the force of spring 32 is sufficient to overcome the force exerted on the rod 26 by the tuned strings 24 at the neutral position.

Figure 3:
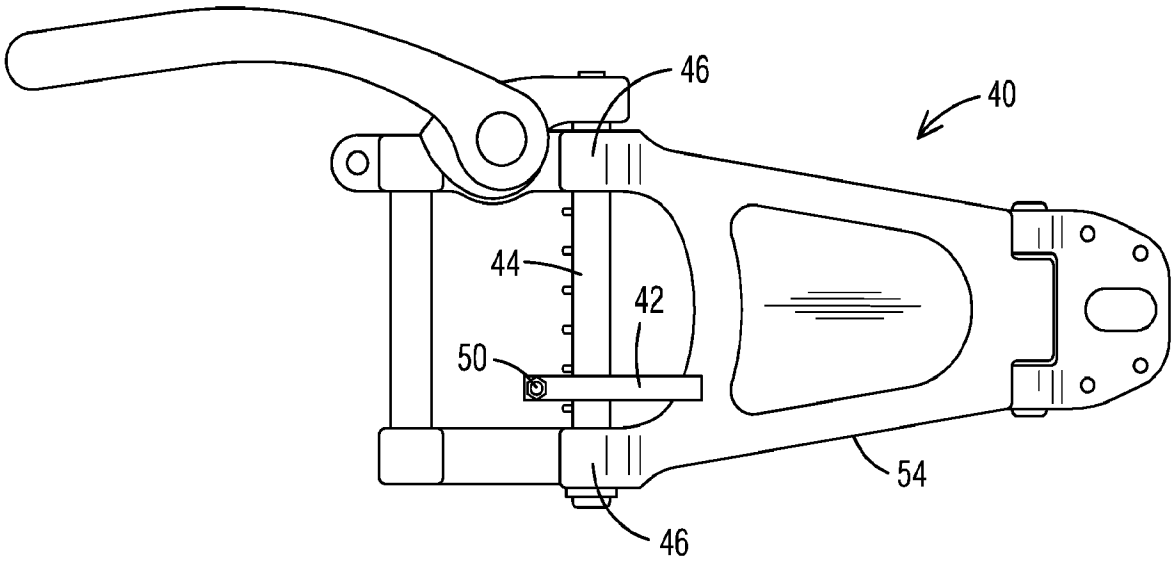
FIG. 3 is a top view of another embodiment of the invention.

One skilled in the art will recognize that the shape of the stop, the way that the stop is connected to or otherwise associated directly or indirectly with the rod, the location of the stop, the surface upon which the stop strikes and the surface of the stop which makes the strike, etc. may be varied in other embodiments of the invention. For example, FIG. 3 is a top view of an improved Bigsby vibrato device 40 utilizing a stop 42 attached to the rod 44 at a position between the bearing areas 46. Two alternative embodiments of the stop 42 are illustrated in FIGS. 4 and 5.

Figure 4:
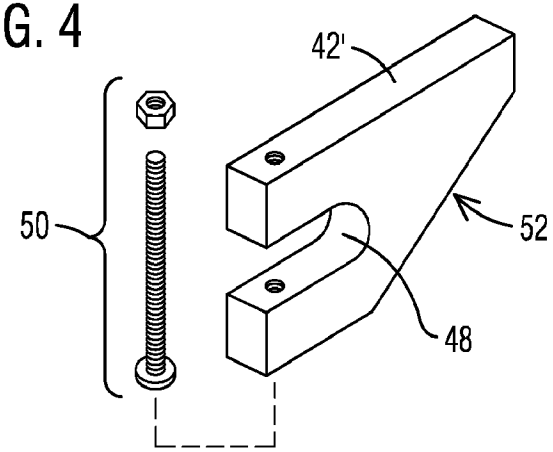
FIG. 4 is a perspective view of a first embodiment of the hard stop of the device of FIG. 3.

FIG. 4 shows a snap type stop 42' which includes a cavity 48 into which the rod 44 is inserted. A bolt and nut combination 50 is used to close the cavity 48 around the rod 44 to secure the stop 42' on the rod 44 in order to prevent relative rotation there between during use of the device. A bottom surface 52 of the stop 42' makes solid contact with the frame 54 of the device 40 to establish the neutral position.

Figure 5:
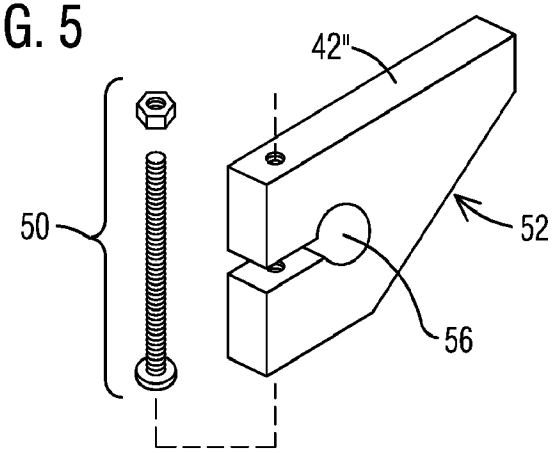
FIG. 5 is a perspective view of a second embodiment of the hard stop of the device of FIG. 3.

FIG. 5 shows an insert type stop 42" having a hole 56 through which the rod 44 is inserted. A bolt and nut combination 50 is used to close the hole 56 around the rod 44 to secure the stop 42" on the rod 44. A bottom surface 52 of the stop 42" makes solid contact with the frame 54 of the device 40 to establish the neutral position.

Figure 6:
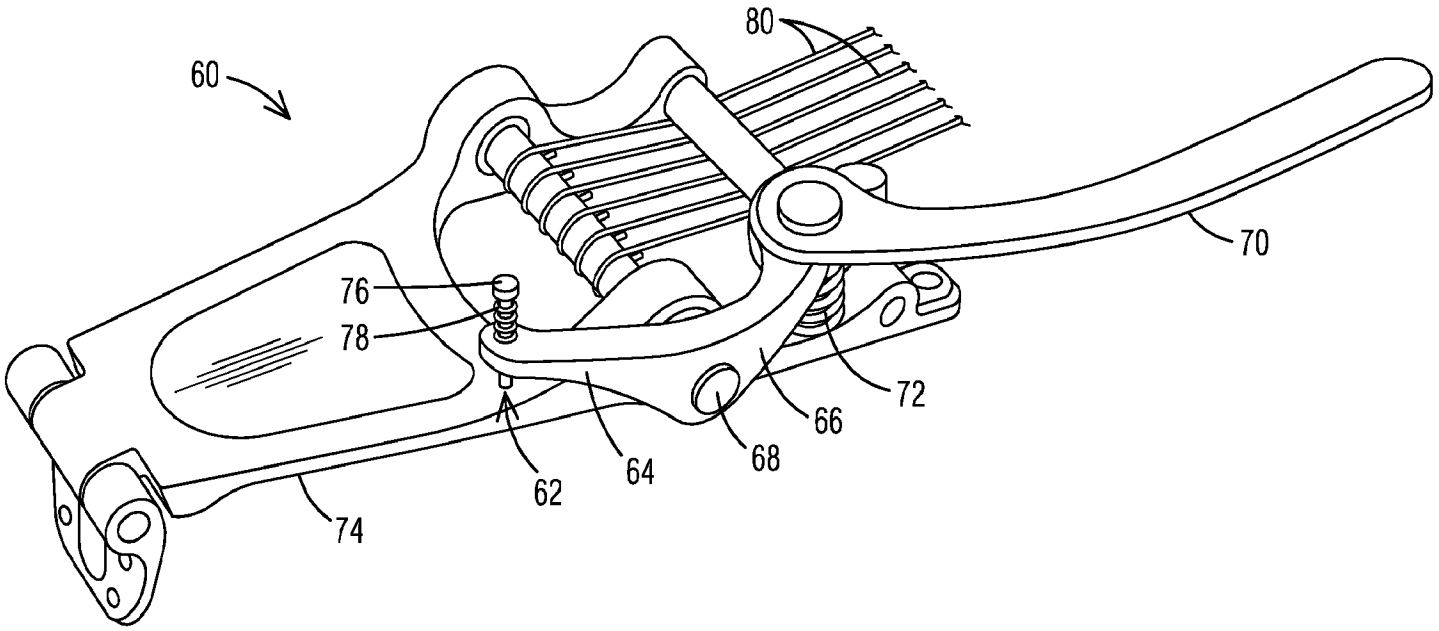
FIG. 6 is a perspective view of another embodiment of the invention utilizing a spring stop.

The embodiments of the invention illustrated in FIGS. 2-5 allow the pitch of the guitar to be lowered by pressing downward on the arm, but they do not permit the pitch of the guitar to be raised by pulling upward on the arm due to the action of the hard stop. FIG. 6 is a perspective view of another embodiment of the invention which allows the pitch to be lowered or raised while still establishing a consistent neutral position. Improved vibrato device 60 includes the usual structures of a prior art Bigsby device, along with a spring stop 62. In this embodiment, the spring stop 62 is attached to an extension 64 of the arm 66 located on a side of the arm 66 opposite of the pivot axis 68 from the portion 70 of the arm 66 grasped by the user. When the arm 66 is depressed by a user and then released from its depressed position, it moves upward due to the action of the spring 72 until the spring stop 62 makes contact with the frame 74 or other part of the guitar. The spring stop 62 includes a bolt or pin 76 extending through an opening in the arm 66 and biased downward against the arm 66 toward the frame 74 by a spring and retaining nut (hidden in this view) on the underside of the extension 64 of the arm 66. Another spring 78 on top of the extension 64 maintains the pin 76 in place through the opening. The pin 76 is thus free to move vertically relative to the arm 66, and a bottom surface of the pin 76 makes contact with the frame 74 to establish the neutral position. The spring stop 62 provides a force sufficient to stop movement of the arm 66 at the neutral position in the absence of any force being applied to the arm 66 by the user. However, the pin 76 can be moved upward relative to the extension 64 when the arm 66 is moved upward past the neutral position in response to an upward force being applied to the arm 66 by the user, thereby increasing the pitch of the strings 80. Once the arm 66 is released from its raised position, it will return to the neutral position under influence of the spring stop 62.

The specific design of the stop may vary in other embodiments, such as by using a leaf spring, a deformable plastic material, a detent, or other mechanism to provide the stopping action upon release of the arm 66, and in the case of a spring stop, allowing further movement of the device 60 past the neutral position in response to a user-applied force. Alternatively, the spring stop may be embodied as a hard stop connected directly or indirectly to the rod or arm to make contact with the frame or guitar body, and a cooperating deformable structure or material such as a spring being applied to the frame or other guitar surface which is contacted by the hard stop. While the spring stop 62 is positioned on the arm 66 in the illustrated embodiment, other designs may include a hard stop or spring stop at any location enabling the described functionality.

Figure 1:
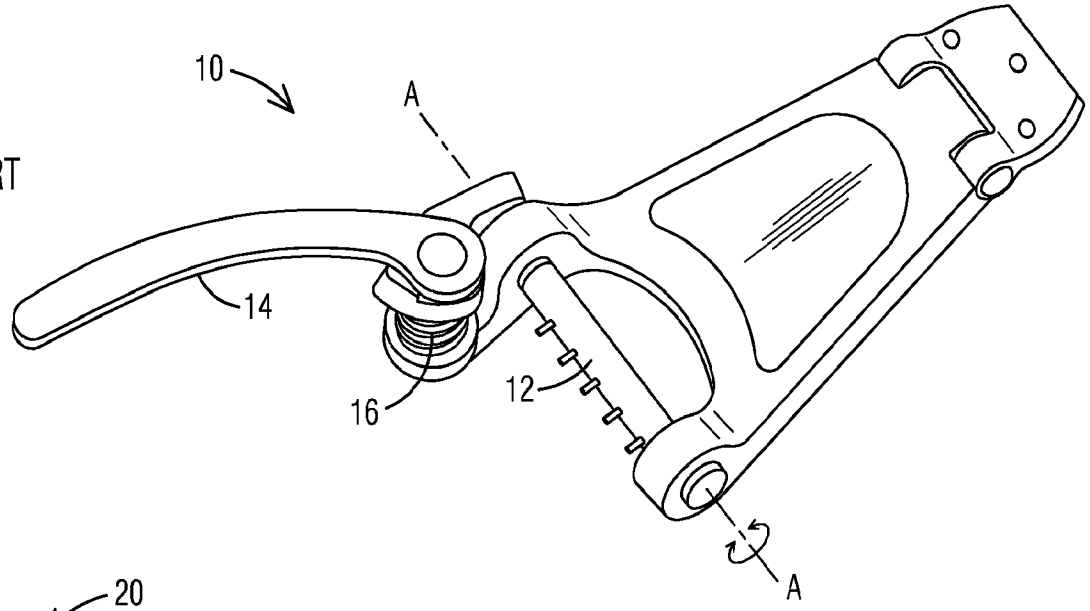
FIG. 1 PRIOR ART
FIG. 1 is a perspective view of a prior art Bigsby vibrato device.
Figure 7A:
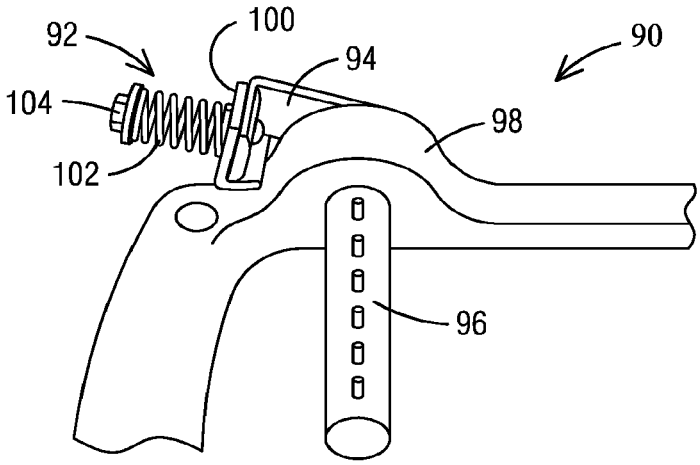
FIG. 7A is a partial perspective view of another spring stop embodiment of the invention in its neutral position.
Figure 7B:
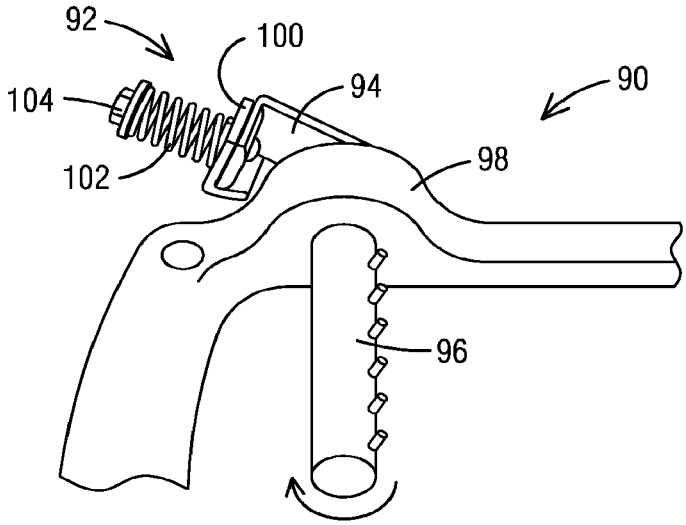
FIG. 7B is a partial perspective view of the device of FIG. 7A in its lowered-pitch position.
Figure 7C:
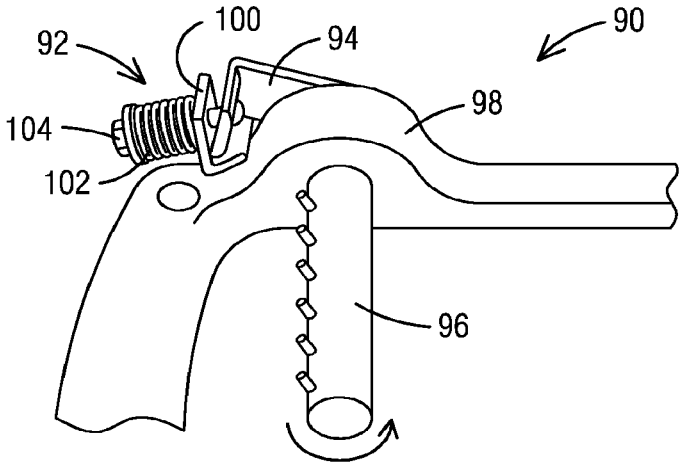
FIG. 7C is a partial perspective view of the device of FIG. 7A in its raised-pitch position.

FIGS. 7A-7C illustrate another embodiment of an inventive vibrato device 90 incorporating a spring stop 92. Device 90 is similar to the device 20 of FIG. 2 in that it includes an L-shaped stop plate 94 attached for rotation with rod 96 relative to frame 98. Those portions of the device 90 that are not illustrated are similar to corresponding portions of the prior art device of FIG. 1. As in FIG. 2, the attachment between stop plate 94 and rod 96 (hidden in FIGS. 7A-7C) may be accomplished by a clamp mechanism, bolting, welding, being integrally formed or any other suitable type of connection. Device 90 also includes a generally L-shaped pivot plate 100 having a surface urged into contact with a surface of stop plate 94 by a spring 102, which in turn is held in position by bolt 104 passing through a hole in the pivot plate 100. The bolt 104 is held in place relative to the stop plate 94 by any convenient attachment, such as a nut/washer, bolt head, or by being threaded into the stop plate 94. A bottom leg of pivot plate 100 extends under the stop plate 94. The bottom surface of the stop plate 94 may be curved or formed at an angle to make generally line contact with the upper surface of the bottom leg of the pivot plate 100 proximate the intrados corner of the bend in the pivot plate 100.

FIG. 7A shows the device 90 in its neutral position with no force being exerted by a user. In the neutral position, the spring located under the vibrator device arm (not shown) urges the rod 96 to rotate against the tension in the strings (not shown) until the pivot plate 100 strikes frame 98 to establish the hard stop neutral position. In this manner the spring stop 92 functions first as a hard stop to establish a consistent neutral position, thereby maintaining the same tension and pitch in the strings any time that the arm is released.

FIG. 7B illustrates the device 90 of FIG. 7A in its lowered-pitch position, when the user exerts a downward force onto the arm, thereby causing rod 96 to rotate in a clockwise direction in the figure. In this position, spring stop 92 is lifted away from frame 98 and the tension in the strings is reduced. Rotational motion in this direction is limited only by the freedom of movement of the arm, not by the spring stop 92. Release of the arm by the user allows the device 90 to return to the neutral position of FIG. 7A.

FIG. 7C illustrates the device 90 of FIG. 7A in its raised-pitch position, when the user exerts an upward force onto the arm, thereby causing rod 96 to rotate in a counterclockwise direction past the neutral position. As stop plate 94 rotates counterclockwise in the figure, its bottom surface (edge) is urged downward onto the top surface of the bottom leg of the pivot plate 100. Because downward movement of the pivot plate 100 is hindered by its contact with the frame 98, a rotational torque is generated in the pivot plate 100, causing its surface to move away from the stop plate 94 by compressing spring 102, as illustrated. This movement increases the tension in the strings and raises the pitch. Release of the arm by the user allows the device 90 to return to the neutral position of FIG. 7A under the influence of the spring 102.

Embodiments of the invention may be incorporated into newly manufactured vibrato devices or may be implemented on an existing prior art vibrato device in order to upgrade the functionality of the prior art device. For example, a kit for modifying a Bigsby vibrato device may be assembled, with the kit including a stop and a mechanism for attaching the stop to a Bigsby vibrato device. The stop and attachment mechanism may be of any of the types described herein, and the kit may include multiple embodiments of the stop and/or attachment mechanism in order to allow the user to select the embodiment that works best with a particular vibrato device or guitar. Such a kit containing a spring stop may include multiple springs or elastomeric materials having differing stiffness coefficients and/or sizes for accommodating particular installation requirements and/or user preferences.

Figure 8A:
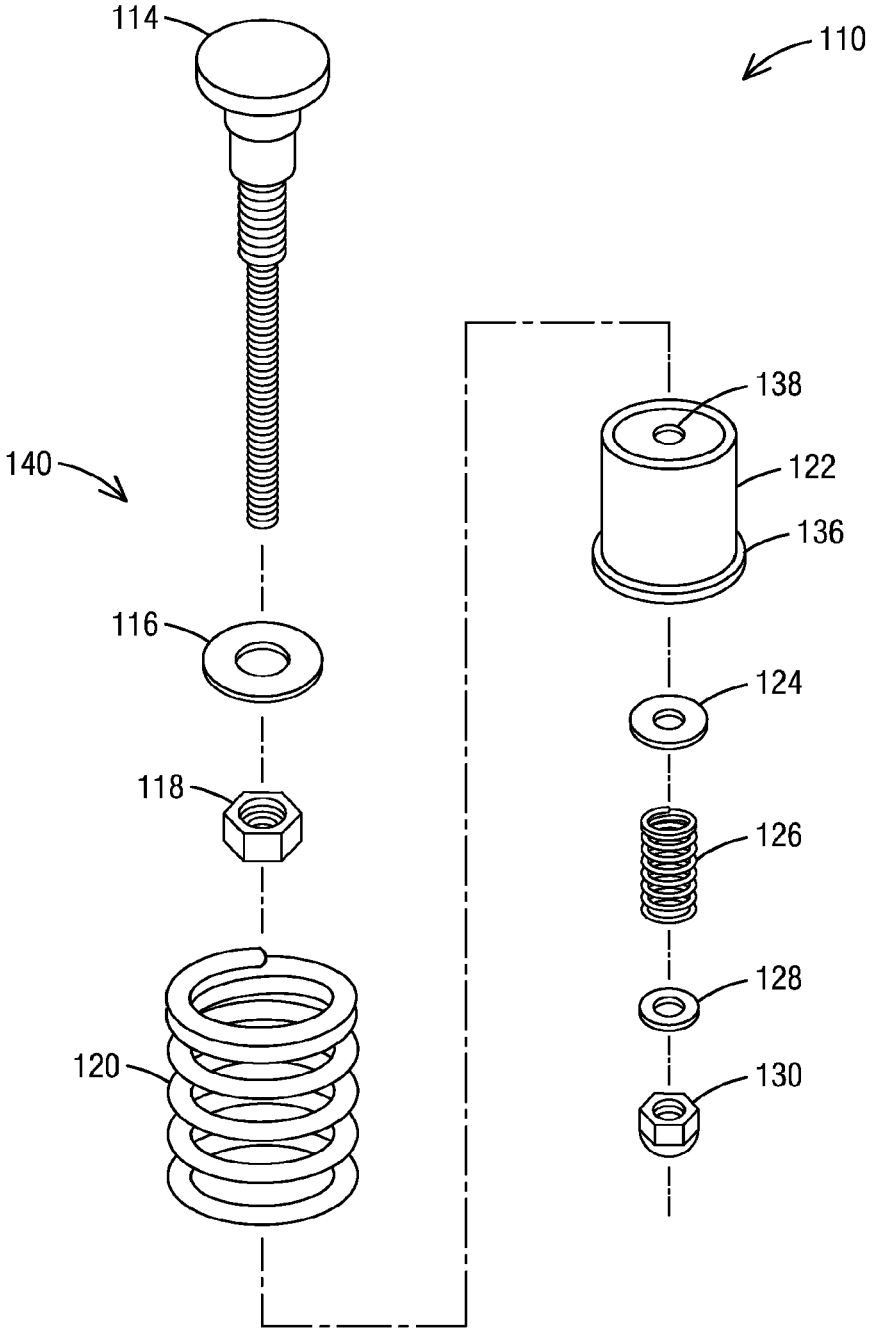
FIG. 8A is a perspective view of a kit for modifying a vibrato device.
Figure 8B:
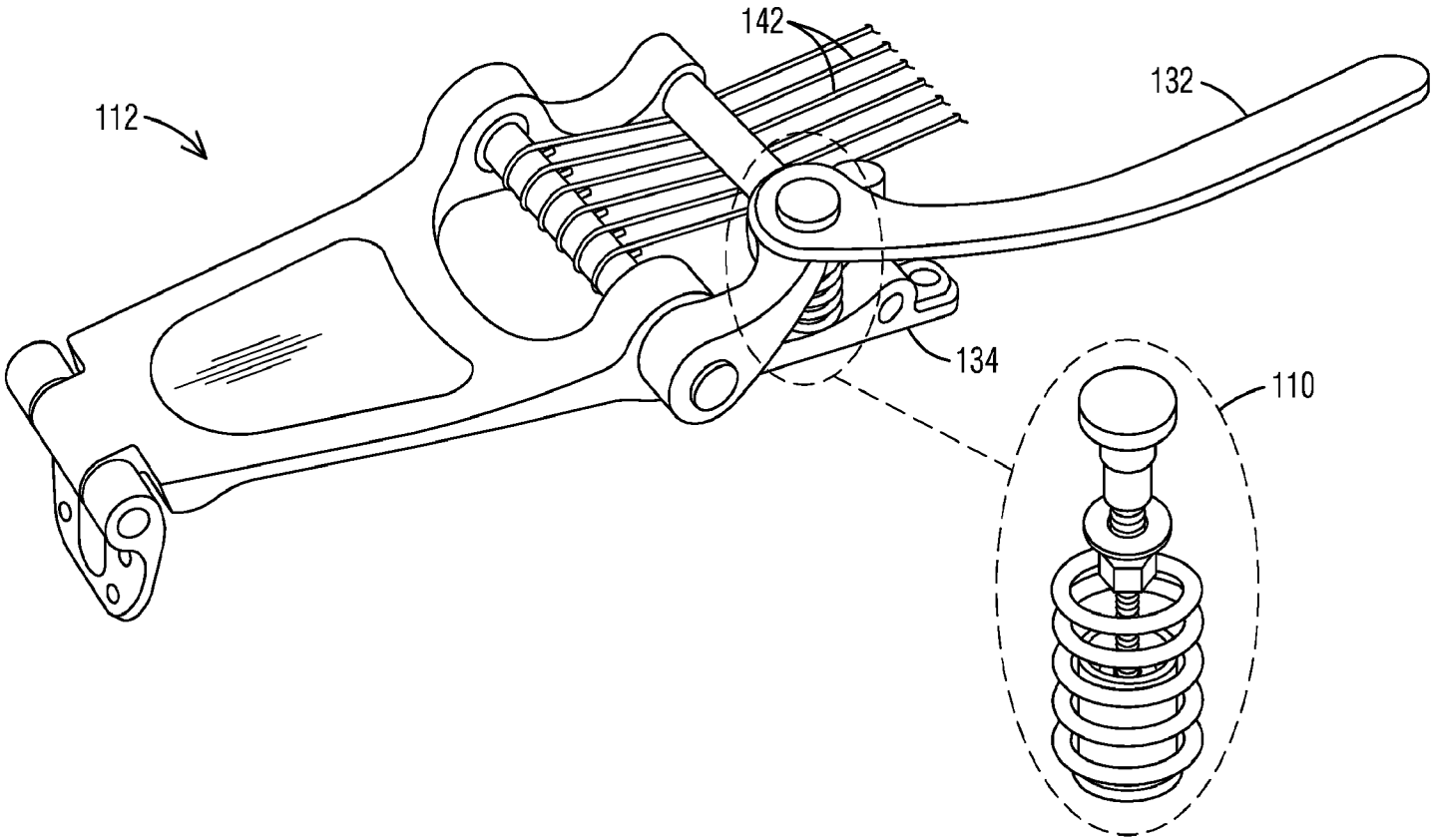
FIG. 8B illustrates a vibrato device modified with the kit of FIG. 8A in accordance with an embodiment of the invention.

One such kit 110 is illustrated in FIG. 8A and is shown as installed in an improved vibrato device 112 in FIG. 8B. The kit of this embodiment includes a bolt 114, a washer 116, a nut 118, optionally a replacement large spring 120, a thimble 122, a washer 124, a small spring 126, a small washer 128, and a nut 130. The provision and use of washers is optional to improve the seating/coupling of the various parts of the device. In this embodiment, the original vibrato device to be modified with the kit 110 includes a rotatable arm extension 132 including an opening (hidden) through which bolt 114 is inserted and secured with washer 116 and nut 118. Nut 118 threads onto an upper, larger-diameter threaded portion of the bolt 114. An opening may exist or need to be formed through the frame 134 to receive the bottom end of bolt 114 in the assembled device 112. Most exiting Bigsby vibrato devices do not include such an opening under the spring, so modification of the existing device frame 134 by drilling a hole may be required for this embodiment. Importantly, however, no modification of the guitar is required in most applications (although optionally an opening may exist or be formed in the guitar face should additional clearance be required for the bolt 114 in a particular application).

The thimble 122 is inserted into the opening in the frame 134 from the underside of the frame 134. The opening in the frame 134 may be counter bored to make contact with the thimble 122 along its rim 136 to resist a lifting force exerted on the thimble 122 during operation of the device. Alternatively, an interference fit may be used between the thimble 122 and the frame 134. The bolt 114 passes through the center of the large spring 120 and into the thimble 122 through an opening 138 in the top of the thimble 122. The small spring 126 is then installed onto the bolt 114 concentric with the large spring 120 and is secured in place with small nut 130, utilizing washers 124 and 128 as appropriate. The position of the washer/small spring/washer/nut combination 124/126/128/130 may be adjusted relative to the thimble 122 during assembly of the device and/or tuning of the guitar such that contact is established with the underside of the top of the thimble 122 at the neutral tuning position to provide the desired stop function. The spring stop 140 of this embodiment consists of the kit 110 less the optional replacement large spring 120. Advantageously, the entire spring stop 140 of this embodiment is located under the arm 132 and between the arm 132 and the frame 134, thus being completely unobtrusive to the user of the guitar.

During use of the vibrato device 112, the arm 132 will assume the neutral position with the tension in the strings 142 counter-balanced by compression in the large spring 120 and contact established by the spring stop 140. The neutral position be shown for example in FIG. 8C. That contact is achieved when washer 124 is urged upward against the underside bottom surface of thimble 122 in the region around opening 138. When the arm 132 is pushed downward by a user to further compress large spring 120 in order to lower the pitch of the strings 142, the bolt 114 moves downward and contact pressure between washer 124 and thimble 122 is removed. See FIG. 8D. Release of the arm 132 allows the large spring 120 to return the device back to the neutral position to reestablish the contact, thereby providing a repeatable neutral tuning position. When the arm 132 is pulled upward away from the frame 134 to raise the pitch of the strings 142, small spring 126 is compressed against the thimble 122 as the bolt 114 and nut 130 are moved upward. See FIG. 8E. Upon release of the arm 132, this compression in small spring 126 causes the device to return reliably to the neutral position.

One may envision an embodiment similar to FIGS. 8A and 8B but with a small spring being located above the arm such that movement of the arm still results in the counter-loading of the large and small springs (i.e. when one spring is being compressed, the other is being relaxed). While such an embodiment may be easier to assemble and to adjust, it would require the bolt and small spring to protrude above the arm, and therefore would not be as compact or visually appealing as is the embodiment of FIGS. 8A and 8B.

Figure 9:
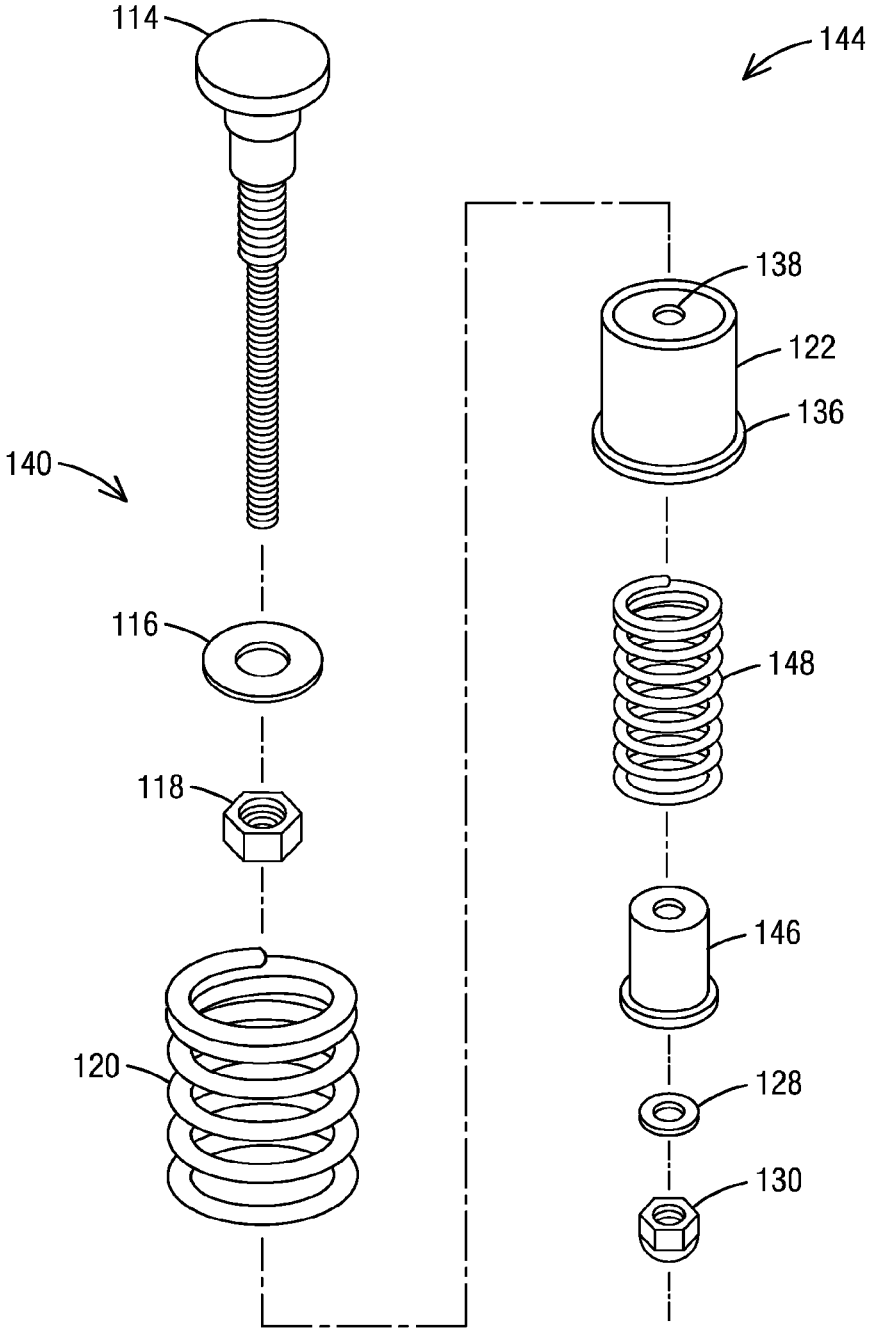
FIG. 9 is a perspective view of another kit for modifying a vibrato device.

FIG. 9 illustrates another kit 144 for modifying a Bigsby vibrato device in accordance with an embodiment of the invention. This kit 144 is similar to the kit 110 shown in FIG. 8A, with like components being numbered consistently between the figures. In lieu of the washer 124 and small spring 126 of FIG. 8A, kit 144 utilizes a small thimble 146 to contact the bottom of small spring 148 when lifting the arm of the vibrato device to raise the pitch of the guitar strings. Small thimble 146 fits within small spring 148, and small spring 148 fits within large spring 120, with relatively small diametrical clearance (e.g. 1/16-1/8 inch) to provide stability and strength when compressing small spring 148.

Figure 10:
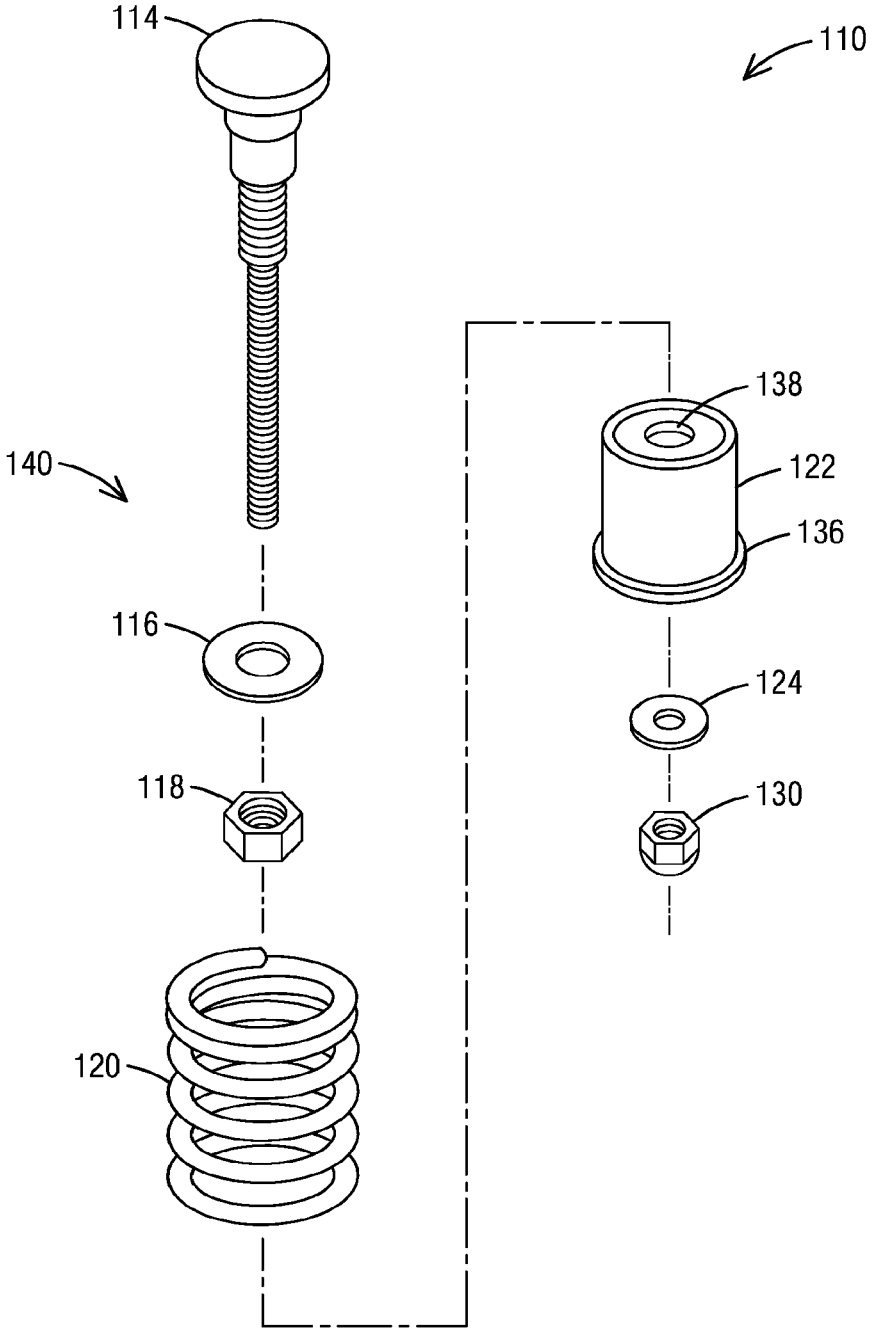
FIG. 10 is a perspective view of yet another kit for modifying a vibrato device.

This strength and stability permits the use of a small spring 148 with a relatively higher spring constant than the small spring 126 used in the embodiment of FIG. 8A, thereby providing a more robust neutral position while still allowing adequate upward and downward movement of the device arm. FIG. 10 illustrates another kit 110 for modifying a Bigsby vibrato device in accordance with an embodiment of the invention. This kit is similar to the kit 110 shown in FIG. 8A, with like components being numbered consistently between the figures. FIG. 10, however provides a basic embodiment that does not include a second spring.

The present invention is not limited to any particular material of construction, and it may be manufactured with materials commonly used in the art of guitars and Bigsby vibrato devices, typically metals such as aluminum and steel, and possibly other structural materials such as hard rubber, reinforced fiberglass or resin materials, etc.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A vibrato device for a guitar comprising:

a frame configured for attachment to a guitar body;

a rod supported by the frame and rotatable about its longitudinal axis relative to the frame;

an arm attached to the rod such that movement of the arm causes rotation of the rod about its longitudinal axis; and a stop associated with the rod and configured to make a contact at a neutral position, wherein the stop comprises a spring stop further comprising:

a stop plate attached for rotation with the rod;

a pivot plate urged against the stop plate by a spring attachment; wherein the pivot plate makes contact against the frame to establish the contact at the neutral position; and wherein the pivot plate is urged away from the stop plate by compression of the spring attachment when the arm is moved past the neutral position to a raised-pitch position.

2. The vibrato device of claim 1, wherein the stop is a hard stop preventing rotation of the rod beyond the neutral position in a direction of the contact.

3. The vibrato device of claim 1, wherein the stop is attached proximate an end of the rod.

4. The vibrato device of claim 1, wherein the rod is supported by the frame at respective bearing areas, and the stop is attached to the rod between the bearing areas.

5. The vibrato device of claim 1, wherein the stop makes the contact with the frame at the neutral position.

6. The vibrato device of claim 1, wherein the stop comprises a spring stop preventing rotation of the rod beyond the neutral position in a direction of the contact when no force is applied to the arm by a user, but allowing rotation of the rod past the neutral position in the direction of contact in response to a force being applied to the arm by the user.

7. The vibrato device of claim 6, further comprising:

a first spring biasing the arm in an upward direction; and the spring stop comprises a second spring providing a force sufficient to stop upward movement of the arm at the neutral position in the absence of the force being applied to the arm by the user, but allowing the arm to move upward past the neutral position in response to the force being applied to the arm by the user.

8. The vibrato device of claim 1, wherein the stop comprises a spring stop and the vibrato device further comprises:

a first spring biasing the arm in a first direction; and a second spring biasing the arm in a second direction opposed the first direction.

9. The vibrato device of claim 8, wherein the spring stop is disposed on a side of the arm opposite of the longitudinal axis from a portion of the arm configured to be grasped by a user.

10. The vibrato device of claim 8, wherein the first spring is disposed between the frame and the arm, and the second spring is disposed concentric with the first spring.

11. The vibrato device of claim 1 in combination with a guitar.

12. A kit comprising:

a mechanical stop;

a bolt;

a nut for securing the bolt to an arm of the Bigsby vibrato device;

a thimble comprising an opening for receiving the bolt;

a spring configured to be disposed about the bolt and within the thimble;

a nut for securing the spring on the bolt such that the spring makes contact against an underside of a top of the thimble at a neutral position of the arm of the Bigsby vibrator device and is compressed when the arm is pulled upward by a user of the Bigsby vibrato device; and a means for attaching the mechanical stop to a Bigsby vibrato device.

* * * * *